US005855742A

United States Patent [19]

Lumbroso et al.

[11] Patent Number: 5,855,742

[45] Date of Patent: Jan. 5, 1999

[54] DECOKING PROCESS AND DEVICE

[75] Inventors: Daniel Lumbroso, Rueil Malmaison; Emile Levallois, Courbevoie, both of France

[73] Assignee: Insitute Francais du Petrole, Rueil-Malmaison, France

[21] Appl. No.: 392,115

[22] Filed: Feb. 22, 1995

[30] Foreign Application Priority Data

Feb. 22, 1994 [FR] France ..... 94/02.097

[51] Int. Cl.[6] ..... C10B 43/00

[52] U.S. Cl. ..... 202/241; 208/48 R; 201/1; 201/2; 134/20; 134/39; 196/122; 196/132; 432/2; 203/4; 203/1

[58] Field of Search ..... 208/48 R; 154/20, 154/39; 196/122, 132; 201/1, 2; 432/2; 203/4, 1; 202/241

[56] References Cited

U.S. PATENT DOCUMENTS

| | | | |
|---|---|---|---|
| 3,412,012 | 11/1968 | Patrick et al. | 208/131 |
| 3,920,537 | 11/1975 | Walker | 208/48 R |
| 4,224,108 | 9/1980 | Takahashi et al. | 196/122 |
| 4,243,633 | 1/1981 | Hozuma et al. | 422/124 |
| 4,275,843 | 6/1981 | Purton et al. | 239/446 |
| 4,818,298 | 4/1989 | Shishkin et al. | 134/24 |
| 4,828,651 | 5/1989 | Lumbrose et al. | 134/24 |
| 4,959,126 | 9/1990 | Tong et al. | 201/2 |
| 5,186,815 | 2/1993 | Lenglet | 208/48 R |
| 5,279,675 | 1/1994 | Verbeek | 134/24 |

FOREIGN PATENT DOCUMENTS

| | | | |
|---|---|---|---|
| 0 227 309 | 7/1987 | European Pat. Off. | C10B 33/00 |
| 2 640 992 | 6/1990 | France | C10B 35/00 |
| 3 008 943 | 10/1981 | Germany | B08B 9/04 |
| 22226389 | 6/1990 | United Kingdom | 201/2 |

*Primary Examiner*—Helane Myers
*Attorney, Agent, or Firm*—Antonelli, Terry, Stout & Kraus, LLP

[57] ABSTRACT

A device for drilling a layer of coke within a reactor to effect the decoking of the reactor includes a decoking tool arranged at one end of a hose for conveying a decoking fluid to the tool. The decoking tool has a first part and a second part coaxial with the first part. The second part has means for ejecting the decoking fluid against the coke layer, including a first ejection means for ejecting the fluid in a substantially axial direction downwardly to penetrate the coke layer, a second ejection means ejecting the fluid in a substantially lateral direction and a third ejection means for ejecting the fluid in a substantially upward direction to remove any coke accumulated above the tool.

8 Claims, 4 Drawing Sheets

DECOKING PROCESS AND DEVICE

FIELD OF INVENTION

The invention relates to a method for coking hydrocarbon feedstocks, heavy distillation products, or residues. It relates in particular to the subsequent stage of recovering the coke (decoking) after it forms in the reactor.

BACKGROUND OF THE INVENTION

Coking is a well-known process in the refining industry and its objective is to upgrade heavy cuts and particularly distillation residues by causing them to undergo thermal decomposition.

This generally takes place in large, empty reactors where distillates are produced by decomposition and released from the reactor while coked products are deposited inside the reactor.

The feedstock is usually introduced at the bottom of the reactor and, in this case, the coke is first deposited on the bottom of the reactor; it then fills up the lower parts of the reactor up to a predetermined height.

At this point, feedstock injection is stopped and this feedstock is sent to a second, empty reactor.

After this first coke formation stage, there is a second stage in which the coke produced is recovered.

For this purpose, after all the residual hydrocarbons have been drained from the reactor and it has been cooled, its upper part is opened and a hole is bored with appropriate tools. These are usually supported by a scaffolding or derrick for boring into the reactor from its top. The derrick structure (one per reactor) is installed around the reactors, themselves located well above ground so that the feedstock can be injected and the coke produced can be recovered from the reactor by gravity then conveyed to a storage area or to the consumer.

Patents FR-2,615,198, FR-2,622,596 and FR-26,640,992 of the applicant describe decoking processes and devices that avoid the derricks around the reactors to make the entire structure simpler, reduce investment cost, and render coke extraction more practical and economical. The teaching in these documents consists in a first stage of spraying water under pressure in the direction of the coke vertically downward such as to penetrate the coke layer, and continuing this operation until the decoking tool reaches the bottom of the reactor, then, in a second stage, ejecting the water sideways and simultaneously raising the tool to empty the reactor. Rotation of the tool is effected by tangential reaction of water in a direction comprising a tangential component or by a mechanical system driven by a water flow tapped off the main flow used to cut the coke.

Since coke is a brittle material, the mass of coke around the hole bored by the downward water jets slumps into a compact mass. When the decoking device is raised, the tool may be caught in this compact mass and a substantial pulling force has to be exerted on the shaft supporting the decoking tool to release it and continue the emptying operation with the aid of side jets. This relatively high pulling force leads to deterioration of the decoking tool and the hose.

SUMMARY OF THE INVENTION

The prior art provides no means for avoiding this deterioration.

The goal of the present invention is to remedy the disadvantages referred to hereinabove. In particular, it allows a sufficient space to be cleared around the tool by sending fluid under pressure to the slumped mass of coke, thus allowing its evacuation.

The present invention relates to a process for emptying coke from a decoking reactor by spraying a decoking fluid under pressure. It is characterized by including at least one step in which said fluid is sprayed under pressure in an upward direction, substantially axially upward.

Decoking fluid can also be sprayed under pressure simultaneously from ejection means hung from a hose in a substantially lateral direction and in a substantially axial direction upward when said ejection means and said hose are raised.

For example, the decoking fluid is sprayed in the substantially axial direction upward from ejection means hung from a hose when raising of the ejection means and the hose is prevented.

This obstacle can for example be the compact mass of coke.

The spraying direction of the decoking fluid may be changed by a spring and a piston moving under the action of pressure variations in the decoking fluid in one direction when the pressure is lowered and in another direction, for example, when the pressure rises.

In this case, the movements of the piston and spring may be effected by stopping and starting a decoking fluid pressurization pump with which the cleaning tool is equipped.

The present invention also relates to a decoking device. It is characterized by comprising, for example, in combination:

a) a hollow hose withstanding pressure and shear forces, b) a means for winding said hose around a shaft that can rotate about its own axis, comprising a means for supplying decoking fluid to the hose at a first end thereof in order to allow passage of said fluid from said feed means into the hose, whatever its degree of winding, and c) a decoking tool comprising:

a first part rigidly and sealably connected to the second end of said hose in order to allow the decoking fluid to pass from the hose to said first part, a second part coaxial with the first part, movable about its axis, means for rotating the second part, a hollow piston disposed inside the second part, displaceable along its axis, means for feeding decoking fluid into the hollow space of the piston from said hose, through the first and second parts of the tool and at least one means allowing said piston to be displaced, at least a first means of ejecting the decoking fluid in a substantially axial, downward direction and at least one second means for ejecting decoking fluid in a substantially lateral direction.

The device is characterized by comprising third means for ejecting the decoking fluid in a substantially axial direction downward, said third ejection means being positioned above said second ejection means, and by comprising means allowing said decoking fluid to be sent from the hollow space alternately to at least said first ejection means and/or said second ejection means and/or said third ejection means, and a means for moving the piston.

The means allowing said piston to be displaced may comprise a recess, a guide pin attached to the second part, and a spring.

The device has means for measuring the force exerted on the hose to trigger upward ejection of the fluid.

The device including the piston has two rows of holes disposed such that the fluid can be ejected laterally and upward simultaneously.

The device including the piston is provided with holes disposed such that the fluid can be ejected laterally and upward, separately.

The process and device are applied in particular for decoking a reactor in the petroleum sphere with pressurized water as the decoking fluid.

Thus, the present invention has numerous advantages, particularly that of offering a simple device, avoiding the erection of derricks and other scaffolding for decoking a reactor in its totality.

Spraying pressurized fluid upward allows the decoking tool to be raised while possibly eliminating obstacles such as a mass of coke that has slumped during the coke boring operation, which stage is prior to the emptying operation. The jets of decoking fluid in an upward direction clear a sufficient space around the decoking tool, breaking up the mass of coke and decompacting it.

Another advantage offered by the system resides in the possibility of possibly eliminating the secondary hydraulic circuit allowing the transition of a decoking fluid jet ejection position from one direction to another.

BRIEF DESCRIPTION OF THE DRAWINGS

The present invention will be better understood and its advantages will emerge clearly from reading the following nonlimiting examples illustrated by the following figures wherein.

DETAILED DESCRIPTION OF THE INVENTION

The device described hereinbelow allows a reactor to be decoked for example while in particular avoiding deterioration of the support shaft of the decoking tool when a mass of coke, a brittle material, has slumped into the hole previously bored by the jets of pressurized fluid, forming a compact mass which may prevent and/or impede the raising of the decoking tool.

Figure 3A:
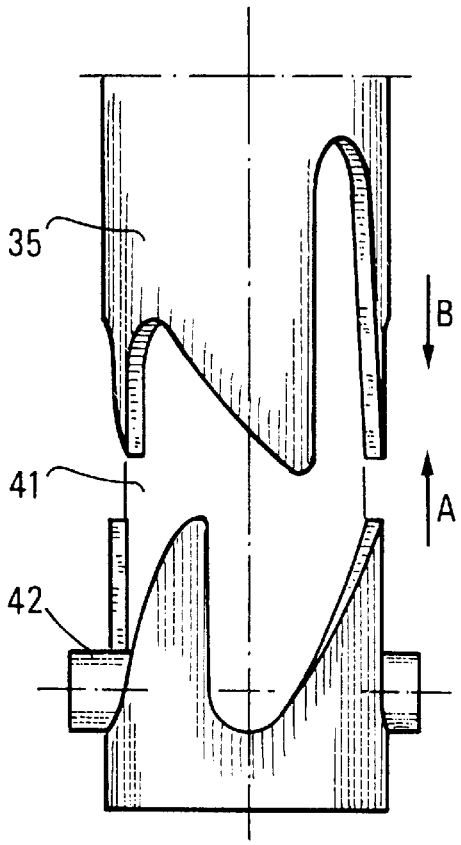
FIGS. 3A, 3B and 3C show details of the entire pressurized decoking fluid distribution system.

The system has for example two coking reactors 1 and 2; reactor 1 may be in the coke emptying stage and reactor 2 in the coke deposition stage (coking). The pipes admitting the hydrocarbon feedstock and tapping off the volatile products have not been shown with a view to simplicity. A winding drum or turret 3 is disposed above the reactors. The axle on which it rotates is hollow and serves to feed decoking fluids such as water supplied under pressure by a pipe 4 through a rotating joint connecting the axle of the turret to the pipe. The drum axle is supported by two rigid flanges of which only one, 5, is visible. The two flanges rest on a chassis 6 provided with wheels such as 7 and 8 allowing the system to move on track 9. The whole is supported by a derrick or superstructure including in particular beams 10 to 12, which derrick can also advantageously be the same derrick that supports the reactors. A shaft such as a hose 14 with high mechanical strength is wound around the drum. The hose is connected to pipe 4 by a coupling, not shown, which allows decoking fluid to be supplied to a decoking tool whatever the position of the drum. The other end of the hose, the end furthest from the drum, carries a decoking tool having a first nonrotating part 16 and a second part 15 capable of rotating about itself, for example under the action of an internal motor, with the rotating part including a piston 35 (FIG. 3A). The greater the weight of the tool, the more stable it is. The second part 15 may comprise downwardly oriented fluid-spraying means or ejectors 17, laterally directed ejectors 18, and upwardly directed ejectors 19. A pulley 20 guides the hose and hence maintains it on the axis of the reactor whatever the degree to which the hose has been wound off the drum.

Eject ion means or ejectors 19 are preferably positioned above laterally directed ejectors 18.

Figure 1:
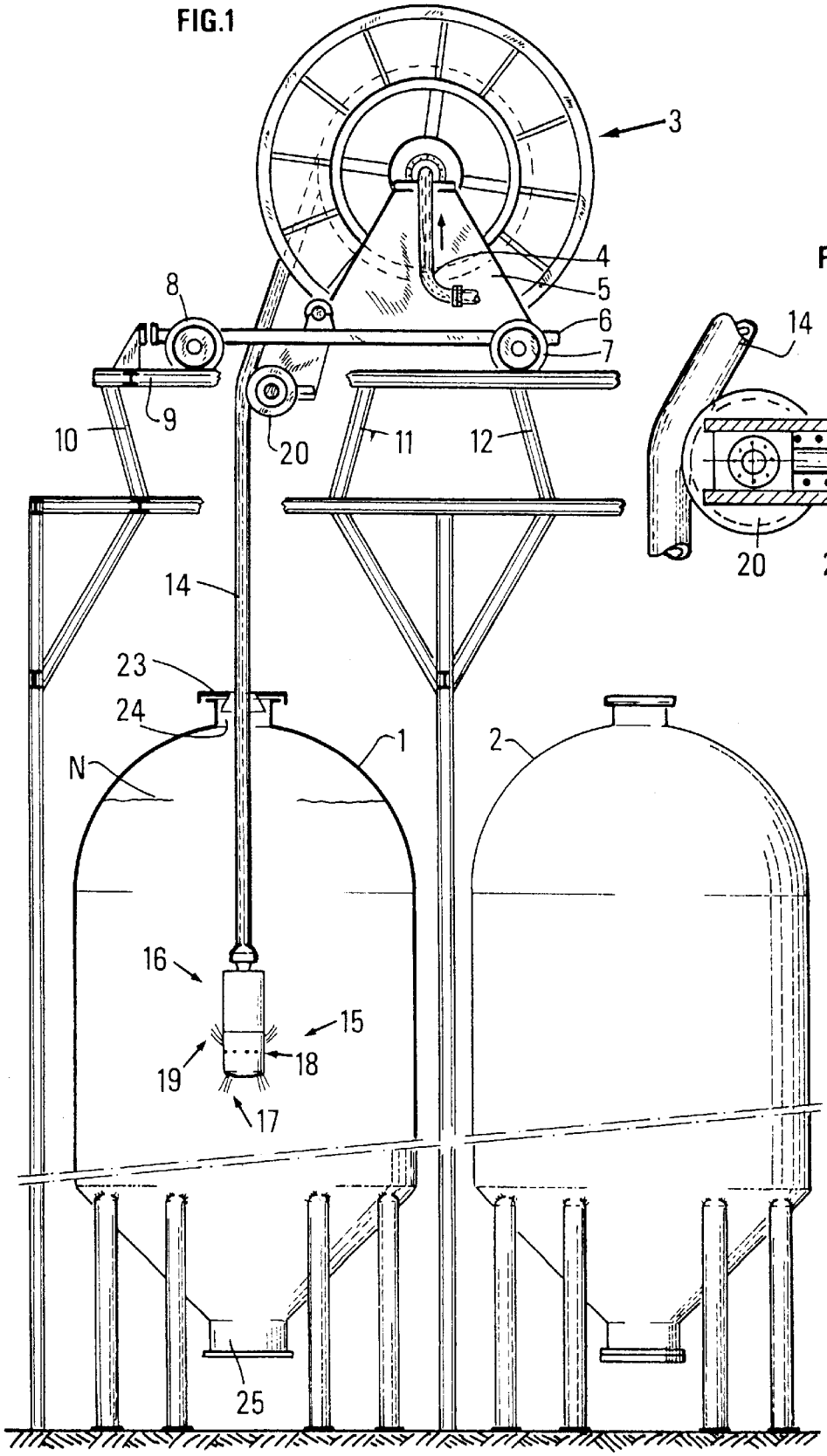
FIG. 1 is an overall view of a system according to the invention.
Figure 1A:
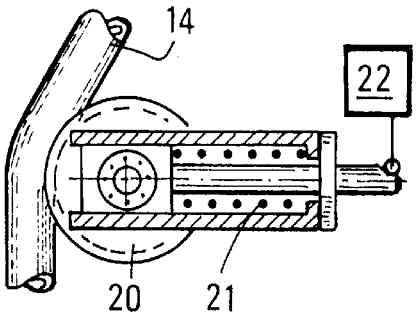
FIG. 1A shows in detail how the measuring device is positioned.

A measuring device 21 (FIG. 1A) may be located at the level of pulley 20. Thus, when the hose is raised and the decoking tool encounters an obstacle, for example a mass of collapsed coke, the hose under tension bears on pulley 20. By positioning a sensor 21 such as a spring on pulley 20, it is possible to register the force applied to the spring, which force represents the tension in the hose when tool 15/16 encounters an obstacle, for example when it is raised, which may lead to locking of the tool.

Measuring device 21 can be positioned at the level of the turret and indicate the rotation of the turret.

Measuring device 21 is for example attached to a monitoring device 22 whose function is to report problems encountered when tool 15/16 is raised and also for example to monitor the sequence of the various steps in the method described hereinbelow.

Device 21 is for example an alarm reporting to the operator a problem occurring in the method steps.

It may also be composed of a microcontroller managing the various steps of the method, including changing the direction of the decoking fluid jets.

A cap or cover 23 may also form part of the device. It is, for example, positioned above tool 15/16 but is not integral with said tool. The presence of this cover serves in particular for protection against the pressurized decoking fluid jets directed upward at the end of the raising operation of tool 15/16.

The hoses used according to the invention have, for example, characteristics substantially identical to those of the hoses described in French Patent FR 2,640,992 of the applicant. They also advantageously have the following characteristics:

their flexibility is adapted to winding onto a drum with a radius of 0.5 to 5 meters for example;

the internal resistance to pressure is at least 100 bars, preferably 150 to 1,000 bars;

the tensile strength is $10^4$ to $10^6$ daN, preferably $2 \cdot 10^4$ to $5 \cdot 10^5$ daN;

rigidity at 20° C.: 50 to 1,000 daN, preferably 100 to 500 daN/$m^2$.

Hoses of this type are sold by the Coflexip Company, France, USA.

The decoking fluid is brought to the decoking tool from a source of decoking fluid, and hoses not shown in the figure for reasons of simplification, up to pipe 4. A pump located between the source and pipe 4, for example, pressurizes the decoking fluid and brings it, for example, to a sufficient pressure value to empty or unload the reactor.

Figure 2:
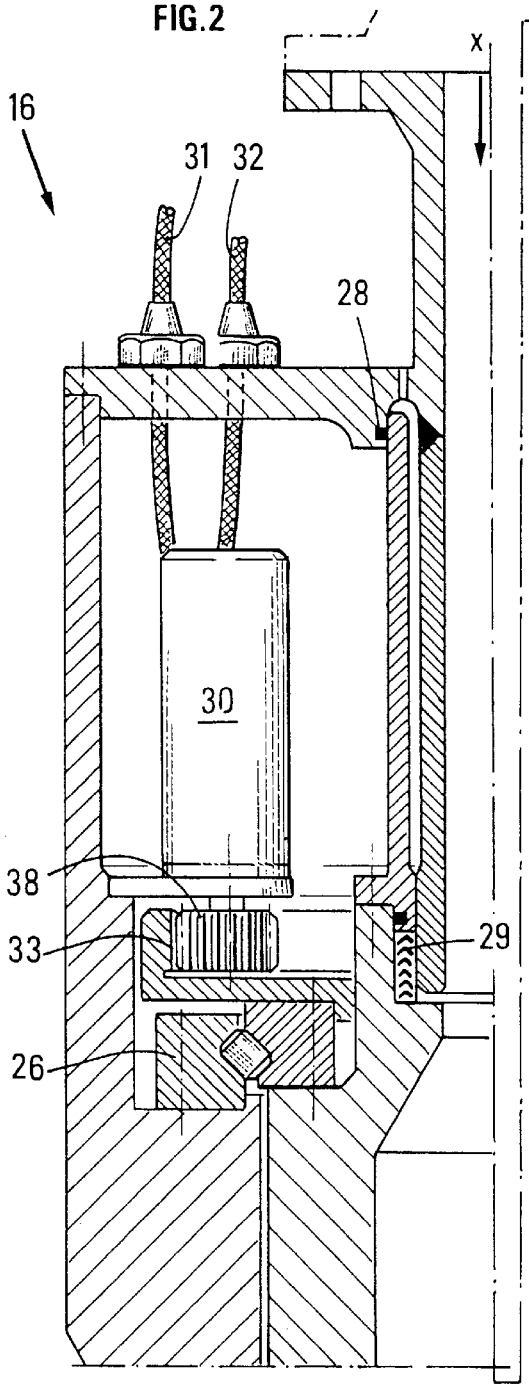
FIG. 2 shows the upper part of the decoking tool.
Figure 2A:
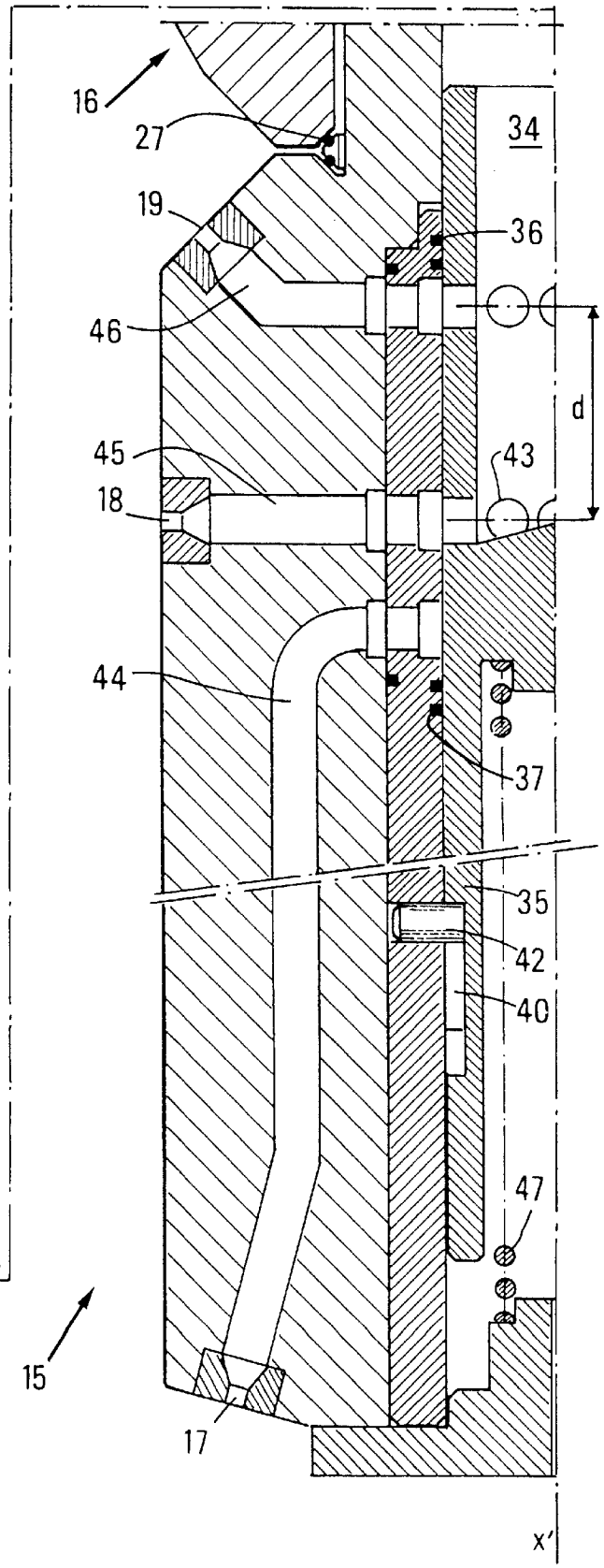
FIGS. 2A, 2B and 2C illustrate several embodiments of the lower part of the decoking tool.

According to one preferred embodiment, part of the decoking fluid is used to control motor 30 (FIG. 2) when the motor is of the hydraulic type. In this case, at least part of the decoking fluid is tapped off by a branch circuit located between the source of decoking fluid and the decoking tool, which elements do not appear in the figure for reasons of clarity.

According to another embodiment, one or more associated hoses connected to an auxiliary fluid source, which hoses are not shown in the figures, serve as auxiliary hydraulic circuits which may control motor 30 (FIG. 2) which starts part 15, when this motor is of the hydraulic type.

Such a device may function as follows: with tool 15/16 initially raised above reactor 1, the upper 24 and lower 25 ends of the coke-filled reactor are opened and the assembly (14, 15, 16) is lowered by paying out hose 14 from its drum 3. As the assembly descends, cover 23 located on the tool descends with the assembly and is then positioned on the upper opening 24 of the reactor to cap it. This cover is simply removed when the decoking operation is at an end by tool 15/16 when it is withdrawn from the reactor.

The pressurized decoking fluid, for example water under pressure, supplying hose 14, is ejected from lower, downward ejectors such as 17 and the hose continues to be lowered into the reactor as a bore is drilled out by the jets in the coke bed.

When the tool arrives at the bottom of the reactor, the coke is entrained through lower opening 25 and falls under the reactor where it is evacuated by conveyors of known type.

Following this step, there are a number of possibilities for emptying the reactor totally, which methods allow in particular any mass of collapsed coke located above the decoking tool and impeding the raising of the tool and hose to be released.

Sometimes the mass of coke located above the decoking tool after or during the coke-boring operation by the downward fluid jets slumps above the tool, forming a compact mass which thus obstructs the passage surrounding the hose and the tool. When the hose and tool are raised to proceed with the ejection operation by the lateral jets toward the walls of the reactor, this mass can impede or prevent such raising.

This problem is remedied for example by spraying decoking fluid, for example pressurized water, in an upward direction, for example in a substantially axial direction upward from ejectors 19. The upwardly sprayed jets thrust the mass of slumped coke upward into riser pipe Cr, particularly in the upper part of the reactor. Since the reactor is not completely full, the part of the coke so thrust will for example be deposited above level N. The pressurized water jets can thus send the mass of coke in a more lateral direction so that the coke is pushed toward the side walls of the reactor.

Upward ejection of pressurized water can be carried out simultaneously with the lateral ejection of water. It can also be effected only when the decoking tool encounters an obstacle as it is raised, which obstacle is for example detected by measuring device 21.

Nonlimiting examples corresponding to these two operating possibilities are described with reference to the following figures.

The coke is thus detached from the reactor walls and evacuated through opening 25.

When the operation is complete, the tool is withdrawn from reactor 1, the drum 3 and its supports are shifted on the rails such as 9, and, once reactor 2 is opened, the hose and tool are lowered in order to decoke reactor 2. Reactor 1 is used for a further decoking operation.

FIGS. 2, 2A, 2B, and 2C show respectively the upper part and the lower part of the decoking tool composed of a nonrotating part 16 rigidly connected to hose 14 and of a part 15 capable of rotating about its lengthwise axis. The join between the two parts is effected for example by rollers such as 26 and seals such as 27, 28, and 29. A drive motor 30 such as a hydraulic motor is driven by part of the decoking fluid taken from the source supplied under high pressure and may be sent toward the outside of part 16 when this fluid is water for example. The fluid driving the motor can also be an auxiliary fluid brought under pressure by a first hose 31 and sent at low pressure through a second hose 32. The rotational speed of the motor can be adjusted by adjusting the flowrate of this auxiliary fluid, and hoses 31 and 32 are continued by hoses not shown in the figure. Motor 30 rotationally drives part 15 for example through a pinion driving a crown 33 rigidly connected to part 15. The motor can also be an electric motor.

Rotating part 15 has an internal cavity 34 in which hollow piston 35 may move. The seal is provided by segments or rings such as 36 and 37.

Orifices such as 43 (FIGS. 2A, 2B, and 2C) are provided in piston 35 to allow passage of the decoking fluid from the hollow space of the piston to one of chambers 44, 45 and 46, which chambers correspond respectively to downward, sideward, and upward ejection of the decoking fluid. The position of orifices 43 allows passage of the decoking fluid to just one of these chambers and/or to several chambers at a time. Hollow piston 35 moves in the direction of arrow A (FIG. 3A) under the action of a spring 47 and in the other direction indicated by arrow B (FIG. 3A) under the action of the hydraulic pressure exerting a higher pressure than that of the spring. This hydraulic pressure may come from the decoking fluid.

Figure 3B:
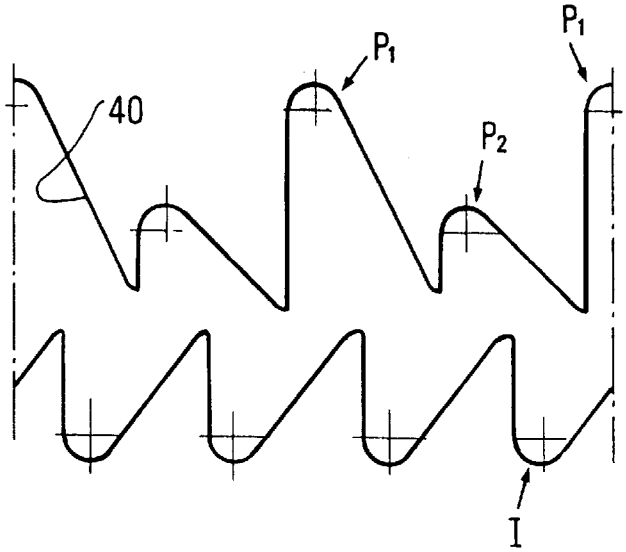
Figure 3C:
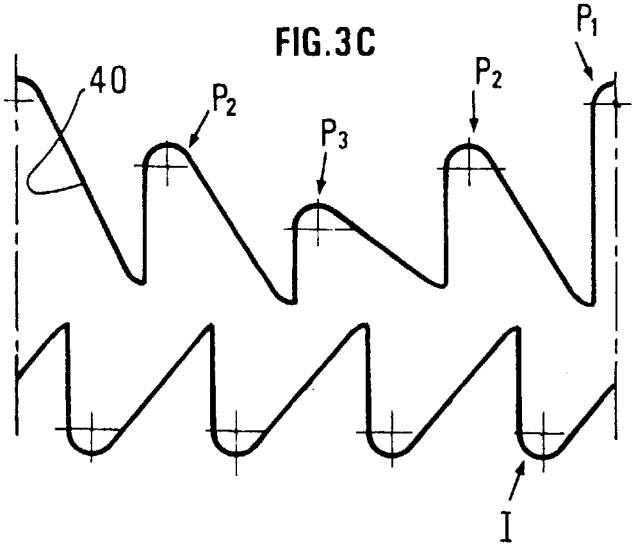

Ramps with given shapes forming a recess 41 are machined for example into piston 35 (FIGS. 3A, 3B, and 3C). A guide pin 42 attached to part 15 penetrates the recess and locks the piston in a given position either under the action of the spring or under the action of pressure.

The method according to the invention can be implemented in several ways, of which two nonlimiting examples will be described hereinbelow.

The first example (FIGS. 2A, 3A, 3B) is particularly suitable when the water used as a decoking fluid has a sufficient flowrate for it to be sprayed in several directions simultaneously, particularly in a substantially lateral direction, toward the reactor walls and in an upward direction.

This method allows continuous freedom from any hang-up problems when the hose and tool are raised, for example when some of the coke mass has slumped. In this embodiment, hollow piston 35 is provided with two rows of orifices or holes 43 spaced apart by a distance d substantially equal to the distance between the axes of chambers 45 and 46 and greater than the distance separating chambers 44 and 45 so that, when the piston is in a low position, corresponding to the operation of boring through the mass of coke in the reactor, in which holes 43 coincide with chamber 44, the upper row of holes 43 does not coincide with any other chamber. In this fashion, only downward passage of the decoking fluid is ensured.

When the hose and tool are raised, the upper row of holes comes to coincide for example with chamber 46 to eject the decoking fluid upward while the lower row of holes comes to coincide with chamber 45 allowing lateral ejection of the decoking fluid.

The holes are made to coincide with a chamber in the following manner for example: under the action of the hydraulic pressure of the decoking fluid, the piston is in a first position P1 corresponding for example to coincidence of holes 43 with decoking fluid downward ejection chamber 44. When the decoking tool reaches the bottom of the reactor, the decoking fluid pressurization pump is stopped, spring 47 moves the piston upward (arrow A, FIG. 3A) in such a way as to release guide pin 42 so that the piston comes to rest in a position 1 in which it remains until the hydraulic pressure exerted by the fluid, for example when the pump is started up again, moves the piston downward. Under the effect of the hydraulic pressure, the piston then enters a recess position P2 and is held in this position by guide pin 42. In this position, the upper row of holes 43 coincides with chamber 46, while the lower row of holes 43 coincides with decoking fluid lateral ejection chamber 45.

Figure 2B:
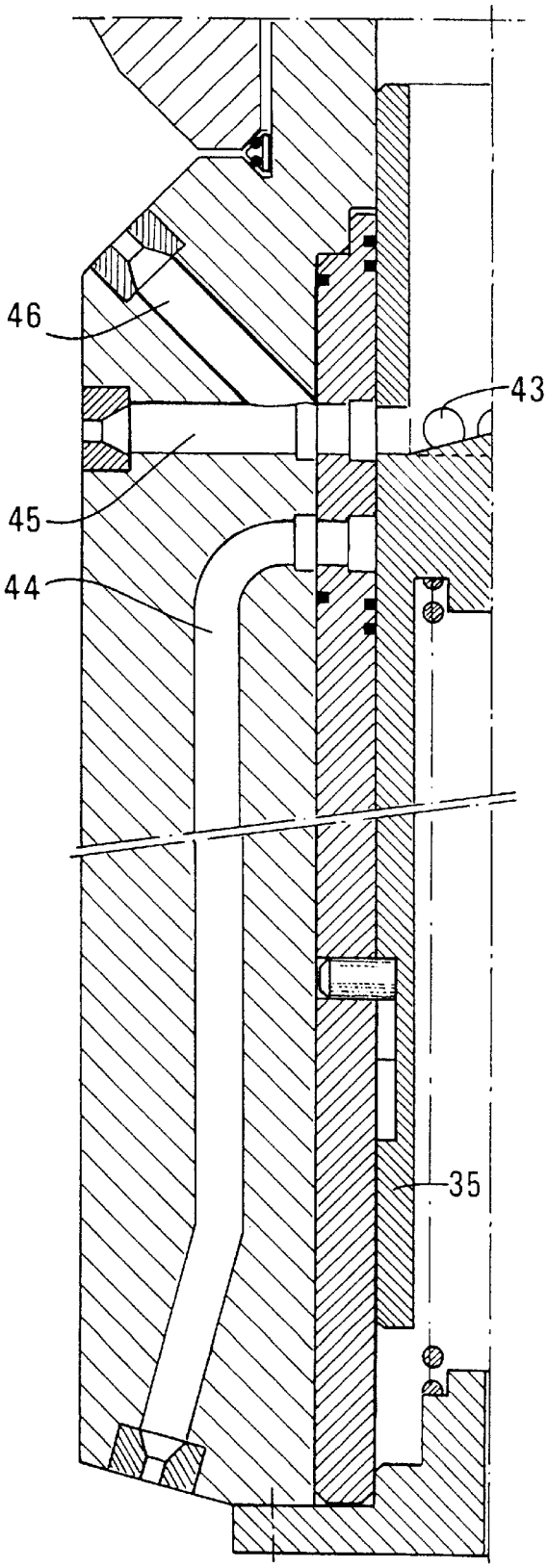
Figure 2C:
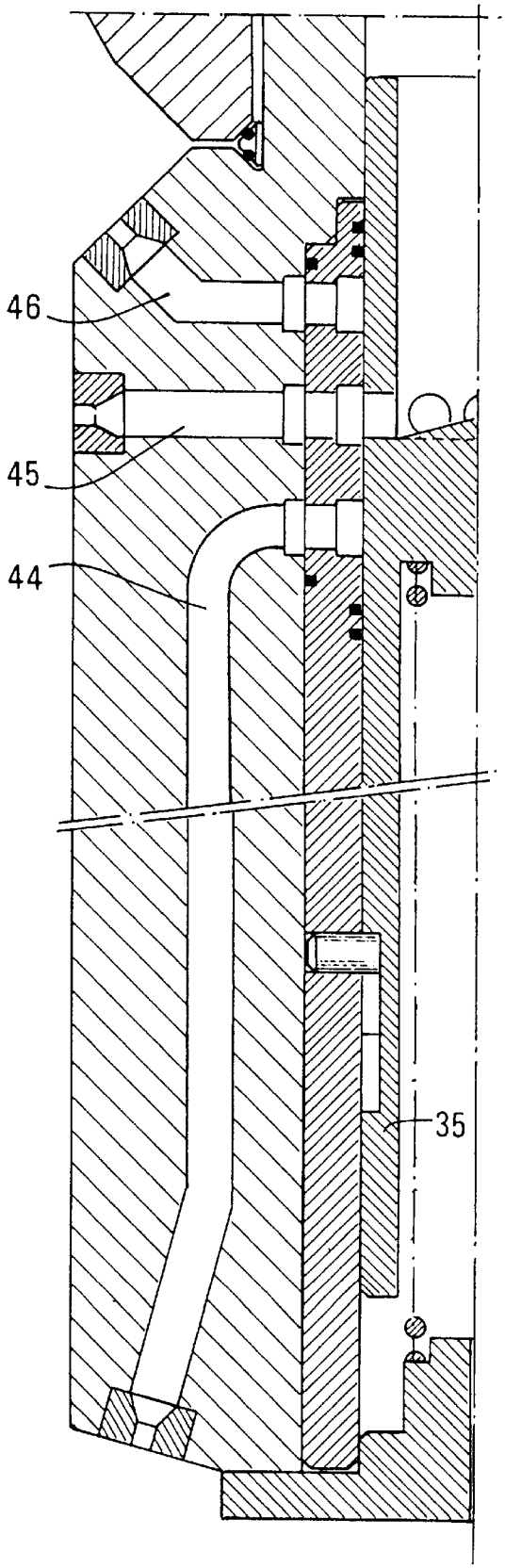

According to another embodiment, FIG. 2B, chambers 45 and 46 may be connected by a single passage connected directly to part 15.

In another preferred embodiment of the invention, implementation of the invention comprises, for example, the steps described hereinbelow.

In this embodiment, the piston is provided with a single row of orifices 43 (FIGS. 2C, 3A, and 3C) which allow the decoking fluid to be dispensed to the various chambers sequentially, namely the decoking fluid is sent to one chamber at a time.

The first step of the method is identical to the coke boring method described above. At the end of this first step, namely when the decoking tool reaches the bottom of the reactor, the piston, under the influence of hydraulic pressure, enters a recess position P2, as described with respect to FIG. 3C, and is held in this position by guide pin 42 in which holes 43 and decoking fluid lateral ejection chamber 45 coincide. The decoking tool is raised, retaining this configuration as long as measuring device 21 detects no problem with the hose-raising operation caused for example by the mass of coke collapsing. As soon as measuring device 23 registers a problem in smooth continuation of the hose-raising operation, resulting for example in an unexpected tension in the hose greater than the threshold value, it reports this to the operator for example who then moves the piston into a position such that holes 43 coincide with decoking fluid upward ejection chamber 46. In this position, the decoking fluid is sent upward and forces the mass of collapsed coke to the upper part of the reactor, thus releasing the tool and the hose. The piston remains in this position until the collapsed mass of coke is cleared so that the hose and tool can be raised once again. Blockage of the tool is signaled for example when measuring device 21 registers a tension value lower than a threshold value. Transition of the piston from a position P2 to a position P3 can be effected as follows, for example: when the decoking fluid is no longer under pressure, the spring pushes the piston upward (arrow A, FIG. 3A) to allow release of guide pin 42 so that the piston enters a third position P3 where it remains until measuring device 21 reports that there is no longer any obstacle to raising the hose, for example by a tension value in the hose being reported to the operator that is less than a preset limit value memorized in the microcontroller. The piston then passes from position P3 to a new position P2 identical to the previous position P2 which corresponds to holes 43 coinciding with decoking fluid lateral ejection chamber 45.

When the piston is in a position P3, the hose-raising operation may be stopped.

The command and control operations may be carried out by a microcontroller equipped with data-gathering and data-processing means, which data come in particular from measuring device 22. The microcontroller is able, for example, to generate control signals, for example, sending them to the decoking fluid pressurization pump to cause the position of the ramps to be changed.

This embodiment is particularly appropriate when the decoking fluid has a pressure limit that does not allow jets of fluid to be sent in several directions simultaneously.

It is preferable to operate with a weight hung from the hose (ejector+any additional weight) of $10^3$ to $5.10^3$ daN, which weight is for example chosen to be compatible with the breaking strength.

The pressurized water is sprayed in substantially axial directions upward and downward and sideward at a pressure of at least 80 to 600 bars and preferably 100 to 400 bars. These pressure values allow the coke escaping at the bottom to be broken up into pieces entrained by the water. The fact of using a high pressure, for example 100 to 400 bars or more, allows relatively large pieces of coke to be obtained, avoiding overly fine dust which is difficult to separate later.

The holes or orifices 43 can be of different shapes. They can be in the shape of a single slot, for example, with a view to simplification of technological implementation.

The spraying of the water and the piston position changes can be remote controlled by any appropriate device (for example remote-controlled conductors incorporated into the hose). In most cases, this avoids having to raise the hose.

The guide drum can be movable. It may for example move on rails and be placed above reactor R1 to be decoked while other reactors are in service or waiting for decoking.

We claim:

1. A device for drilling a coke layer within a reactor to effect decoking of the reactor comprising:

a) a hollow hose withstanding pressure and shear forces, b) means for winding said hose around a shaft that can rotate about its own axis, and feed means for supplying decoking fluid to the hose at a first end thereof in order to allow passage of said fluid from said means into said hose, whatever its degree of winding, and c) a decoking tool comprising:

a first part rigidly and sealably connected to a second end of said hose in order to allow the decoking fluid to pass from the hose to said first part, a second part coaxial with the first part, movable about its axis, means for rotating the second part, a hollow piston disposed inside the second part, displaceable along its axis, means for feeding decoking fluid into the hollow space of the piston from said hose, through the first and second parts of the tool and at least one means allowing said piston to be displaced, said second part comprising at least a first ejection means for ejecting the decoking fluid in a substantially axial, downward direction in order to penetrate the coke layer, at least one second ejection means for ejecting decoking fluid in a substantially lateral direction and at least a third ejection means for ejecting the decoking fluid in a substantially axial direction upward to remove any obstacles and clear a sufficient space around the decoking tool to permit raising of the decoking tool, said third ejection means being positioned above said second ejection means, wherein said piston and said means for allowing said piston to be displaced allows the decoking fluid to be sent from the hollow space alternately to at least said first ejection means and/or said second ejection means and/or said third ejection means.

2. A device according to claim 1 wherein the means allowing said piston to be displaced comprises a recess, a guide pin attached to the second part and a spring.

3. A device according to claim 1, further comprising means for measuring the force exerted on the hose to trigger upward ejection of the fluid.

4. A device according to claim 1, wherein said hollow piston has two rows of holes disposed such that the fluid can be ejected laterally and upward simultaneously.

5. A device according to claim 1, wherein said hollow piston is provided with holes disposed such as to eject the fluid sideward and upward, separately.

6. Device according to claim 1, further comprising a measuring device to measure tension in said hose to detect said decoking tool encountering an obstacle during the raising thereof.

7. Device according to claim 6, further comprising a monitoring device operably connected to said measuring device to report the encountering of an obstacle to an operator.

8. Device according to claim 6, further comprising a controller operably connected to said measuring device for controlling said means for allowing said piston to be displace to enable activation of said third ejection means upon detection of an obstacle by said measuring device.

* * * * *